US012123196B2

(12) United States Patent
Bolon et al.

(10) Patent No.: US 12,123,196 B2
(45) Date of Patent: Oct. 22, 2024

(54) GUTTER PROTECTION SYSTEM AND METHOD

(71) Applicant: GLOBAL GUTTER GUARDS, LLC, North Canton, OH (US)

(72) Inventors: Kip Bolon, North Canton, OH (US); Dennis Elliott, Canton, OH (US); Jason Johnson, New Philadelphia, OH (US)

(73) Assignee: GLOBAL GUTTER GUARDS, LLC, North Canton, OH (US)

( * ) Notice: Subject to any disclaimer, the term of this patent is extended or adjusted under 35 U.S.C. 154(b) by 66 days.

(21) Appl. No.: 17/871,012

(22) Filed: Jul. 22, 2022

(65) Prior Publication Data

US 2023/0024591 A1 Jan. 26, 2023

Related U.S. Application Data

(60) Provisional application No. 63/224,612, filed on Jul. 22, 2021.

(51) Int. Cl.
*E04D 13/076* (2006.01)
*E04D 13/072* (2006.01)

(52) U.S. Cl.
CPC ..... *E04D 13/076* (2013.01); *E04D 13/0725* (2013.01)

(58) Field of Classification Search
CPC ..... E04D 13/0725; E04D 13/0727; E04D 13/076
See application file for complete search history.

(56) References Cited

U.S. PATENT DOCUMENTS 2,810,173 A * 10/1957 Bearden ..... E04D 13/076 248/48.1
5,010,696 A 4/1991 Knittel
5,899,023 A * 5/1999 Byer ..... E04D 13/076 52/12
7,310,912 B2 12/2007 Lenney et al.
7,975,435 B2 7/2011 Lenney et al.
8,479,454 B2 7/2013 Lenney et al.
9,487,955 B2 11/2016 Breyer et al.
9,765,524 B2 9/2017 Lenney
(Continued)

FOREIGN PATENT DOCUMENTS

WO 2007/100320 A1 9/2007

*Primary Examiner* — Adriana Figueroa
(74) *Attorney, Agent, or Firm* — Jacob M. Ward; Ward Law Office LLC

(57) ABSTRACT

A gutter protection system configured for engagement with a rain gutter is provided. The gutter protection system includes a bracket configured for attachment to a first portion of the rain gutter. The bracket has a first arm and a second arm, each forming a channel. A base member has a first end configured for insertion into the channel formed by the first arm or the second arm of the bracket. The base member has an opposing second end configured for engagement with a second portion of the rain gutter. The base member further includes an intermediate segment extending from the first end to the second end. The intermediate segment includes a plurality of apertures. A permeable member is seated against an upper surface of the base member and is configured to facilitate the flow of water through the gutter protection system and into the rain gutter.

20 Claims, 4 Drawing Sheets

(56) References Cited

U.S. PATENT DOCUMENTS

| | | | | |
|---|---|---|---|---|
| 9,863,150 | B2 * | 1/2018 | Lenney | E04D 13/076 |
| 9,890,535 | B2 | 2/2018 | Breyer et al. | |
| 10,443,244 | B2 * | 10/2019 | Gori | E04D 13/076 |
| 10,458,121 | B2 | 10/2019 | Lenney | |
| 10,513,852 | B2 | 12/2019 | Gori | |
| 10,633,868 | B2 * | 4/2020 | Gori | E04D 13/076 |
| D885,529 | S | 5/2020 | Gori et al. | |
| D885,530 | S | 5/2020 | Gori et al. | |
| D885,531 | S * | 5/2020 | Gori | D23/267 |
| D885,532 | S | 5/2020 | Gori | |
| 10,655,332 | B2 * | 5/2020 | Gori | E04D 13/076 |
| 10,655,333 | B2 | 5/2020 | Gori | |
| 10,655,334 | B2 * | 5/2020 | Gori | E04D 13/076 |
| D890,601 | S * | 7/2020 | Gori | D8/394 |
| D890,602 | S * | 7/2020 | Gori | D8/394 |
| 10,711,464 | B1 * | 7/2020 | Tatasciore | E04D 13/068 |
| 10,801,208 | B1 * | 10/2020 | Bryer | E04D 13/076 |
| 10,808,408 | B1 * | 10/2020 | Tatasciore | E04D 13/0767 |
| D905,833 | S | 12/2020 | Breyer | |
| D909,546 | S | 2/2021 | Breyer | |
| 11,078,670 | B2 * | 8/2021 | Gori | E04D 13/076 |
| 11,898,353 | B2 * | 2/2024 | Lenney | E04D 13/076 |
| 2013/0248672 | A1 | 9/2013 | Martin | |
| 2019/0218783 | A1 | 7/2019 | Gori | |
| 2020/0181914 | A1 | 6/2020 | Lenney | |
| 2020/0347604 | A1 | 11/2020 | Lenney | |
| 2020/0378128 | A1 | 12/2020 | Iannelli | |
| 2021/0002899 | A1 | 1/2021 | Lenney | |
| 2022/0042315 | A1 * | 2/2022 | Neeb | E04D 13/068 |

* cited by examiner

GUTTER PROTECTION SYSTEM AND METHOD

CROSS-REFERENCE TO RELATED APPLICATIONS

This application claims the benefit of U.S. Provisional Application No. 63/224,612 filed on Jul. 22, 2021. The entire disclosure of the above application is incorporated herein by reference.

FIELD

The disclosure generally relates to water diversion systems and, more particularly, to systems and methods for militating against debris from entering rain gutters.

INTRODUCTION

The statements in this section merely provide background information related to the present disclosure and may not constitute prior art.

Rain gutters are commonly used for residential homes, buildings, and other structures to manage the flow of rainwater by collecting the rainwater and channeling that rainwater away from the structure. Such management of the flow of rainwater can be critical for the overall maintenance and condition of the structure by reducing or eliminating damage to the structure and its foundation that can be caused by uncontrolled rainwater. Gutter protection systems (commonly called gutter guards) are components or systems that are typically attached to or incorporated into rain gutters to prevent leaves, pine needles, branches, soot, and other such debris from entering the rain gutter. Such debris can clog the rain gutter and reduce its effectiveness in channeling rainwater away from a residential home, building, or other structure. In addition, such debris can damage and shorten the service life of a rain gutter by causing corrosion, pitting, or other deleterious effects on the rain gutter. Known gutter protection systems do not effectively militate against debris from entering the gutters while efficiently permitting water to pass through the gutter protection systems. Inefficient water management designs, matting of debris onto the gutter protection systems over time, and ill-fitting gutter protection systems cause unnecessary damage to homes and other structures, which reduces property values, increases maintenance costs, and causes dangerous conditions for occupants of structures.

Gutter protection systems are typically manufactured to fit a specific style and specific size of rain gutter. Such gutter protection systems are typically manufactured as a single component or assembly of subcomponents, where the subcomponents are irreversibly joined together. Thus, gutter protection systems manufacturers, distributors, and/or dealers typically choose between making and/or stocking a limited number of products that accommodate a limited segment of the market or making and/or stocking a large number of products to accommodate the large number of variations of rain gutter protection systems.

There are many different sizes and styles of rain gutters on the market in the United States and internationally. The differences in rain gutter sizes and styles are driven by a number of factors including different architectural styles for homes and buildings in different geographical regions and regional homebuilder/contractor trade practices that develop over time. Such different architectural styles can also be driven by differences in climate and weather patterns (for example, annual rain and snow fall), historical influences, availability of building materials, and so on. The different architectural styles often dictate the rooflines of structures, which in large part dictates the style and size of rain gutters and how the rain gutter is attached to the structure/roofline. The term "structure" is used herein generically to mean a residential home, multi-residential buildings, office buildings, warehouses, commercial building, or any other structure for which rain gutters are used to channel rainwater away from the structure. The term "roofline" is used herein generically to mean the intersection of the underside of the roof of a structure with the exterior walls of the structure and/or other proximal exterior features such as rafter tails, fascia board, starter strips, flashing, drip edges, and so on.

As will be appreciated from the following discussion, the number of variations in types of rain gutters, sizes of rain gutters, mechanisms for securing rain gutters to structures and/or rooflines, etc. creates a plethora of potential combinations of rain gutter arrangements. Thus, designing a generic gutter protection system to accommodate such a large number of potential combinations is a challenge that has yet to be met in the marketplace. Due to the variety of sizes and styles of gutters in the marketplace, current business models in the industry are for manufacturers, distributors, and/or dealers to manufacture and/or stock a limited number of gutter protection system that accommodate a limited segment of the market, or to manufacture and/or stock a large number of gutter protection systems to accommodate the large number of variations of rain gutters. Such approaches are both limited and inefficient. These currently available gutter protection systems create inefficient and costly supply chain logistics for storing and shipping many variations of differently sized gutter protection systems. There is a need for improvement to existing gutter protection systems and/or methods for gutter protection systems to accommodate a more efficient and effective business model for manufacturing, distributing, and installing gutter protection systems to the diverse and disparate national and regional marketplace.

Furthermore, the currently available gutter protection systems do not adequately militate against debris from collecting on and/or passing through the gutter protection systems. The connection areas between segments of the currently available gutter protection systems may include gaps that permit debris to undesirably enter the gutter. Additionally, currently available gutter protection systems are constructed in a manner that traps and/or collects debris on a top surface of the gutter protection systems, thereby blocking water from passing through the gutter protection systems.

As can be seen, there is a need for an improved gutter protection system and method that is configured to be adjustable to a wide variety of gutter sizes and styles, provides greater protection for militating against debris from entering the gutter protection system, improves the water flow rate through the gutter protection system, and is structurally enhanced.

SUMMARY

It should be appreciated that this Summary is provided to introduce a selection of concepts in a simplified form, the concepts being further described below in the Detailed Description. This Summary is not intended to identify key features or essential features of this disclosure, not is it intended to limit the scope of the gutter protection systems and method.

The above objects as well as other objects not specifically enumerated are achieved by a gutter protection system configured for engagement with a rain gutter. The gutter protection system includes a bracket configured for attachment to a first portion of the rain gutter. The bracket has a first arm and a second arm. Each of the first and second arms forms a channel. A base member has a first end configured for insertion into the channel formed by the first arm or the second arm of the bracket. The base member has an opposing second end configured for engagement with a second portion of the rain gutter. The base member further includes an intermediate segment extending from the first end to the second end. The intermediate segment includes a plurality of apertures. A permeable member is seated against an upper surface of the base member and is configured to facilitate the flow of water through the gutter protection system and into the rain gutter.

The above objects as well as other objects not specifically enumerated are also achieved by a method of assembling a gutter protection system. The method including the steps of attaching a first portion of a bracket to a rain gutter, the bracket having a first arm and a second arm, each of the first and second arms forming a channel, inserting a first end of a base member into the channel formed by the first arm or the second arm of the bracket, the base member further having an opposing second end configured for engagement with a second portion of the rain gutter, the base member further including an intermediate segment extending from the first end to the second end, the intermediate segment including a plurality of apertures and seating a permeable member against an upper surface of the base member, the permeable member configured to facilitate the flow of water through the gutter protection system and into the rain gutter.

The above objects as well as other objects not specifically enumerated are also achieved by a kit for a gutter protection system. The kit includes a bracket configured for attachment to a first portion of the rain gutter. The bracket has a first arm and a second arm, each of the first and second arms forming a channel. A base member has a first end configured for insertion into the channel formed by the first arm or the second arm of the bracket. The base member further has an opposing second end configured for engagement with a second portion of the rain gutter. The base member further includes an intermediate segment extending from the first end to the second end. The intermediate segment includes a plurality of apertures and a permeable member is seated against an upper surface of the base member and configured to facilitate the flow of water through the gutter protection system and into the rain gutter.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
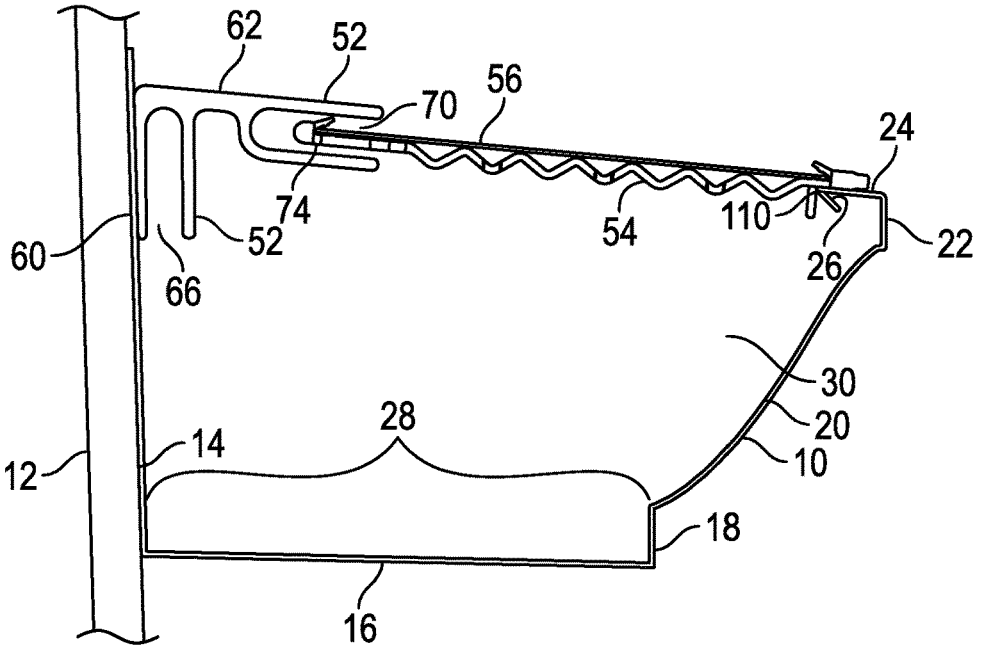
FIG. 1 is a side elevational view of a rain gutter fitted with a gutter protection system in accordance with one embodiment of the invention.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9,1-8,1-3,1-2,2-10, 2-8,2-3,3-10,3-9, and so on.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the FIGS. is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In accordance with the illustrated embodiments of the present disclosure, a novel gutter protection system has surprisingly been discovered, along with methods of using the novel gutter protection system and a kit forming a novel gutter protection system. Generally, the novel gutter protection system engages a conventional rain gutter and. The gutter protection system includes a bracket that attaches to a first portion of the rain gutter. The bracket has a first arm and a second arm. Each of the first and second arms forms a channel. A first end of a base member is inserted into the channel formed by the first arm or the second arm of the bracket. An opposing second end of the base member engages with a second portion of the rain gutter. An intermediate segment of the base member extends from the first end to the second end of the base member. The intermediate segment includes a plurality of apertures and a permeable member is seated against an upper surface of the base member and is configured to facilitate the flow of water through the gutter protection system and into the rain gutter.

Figure 2:
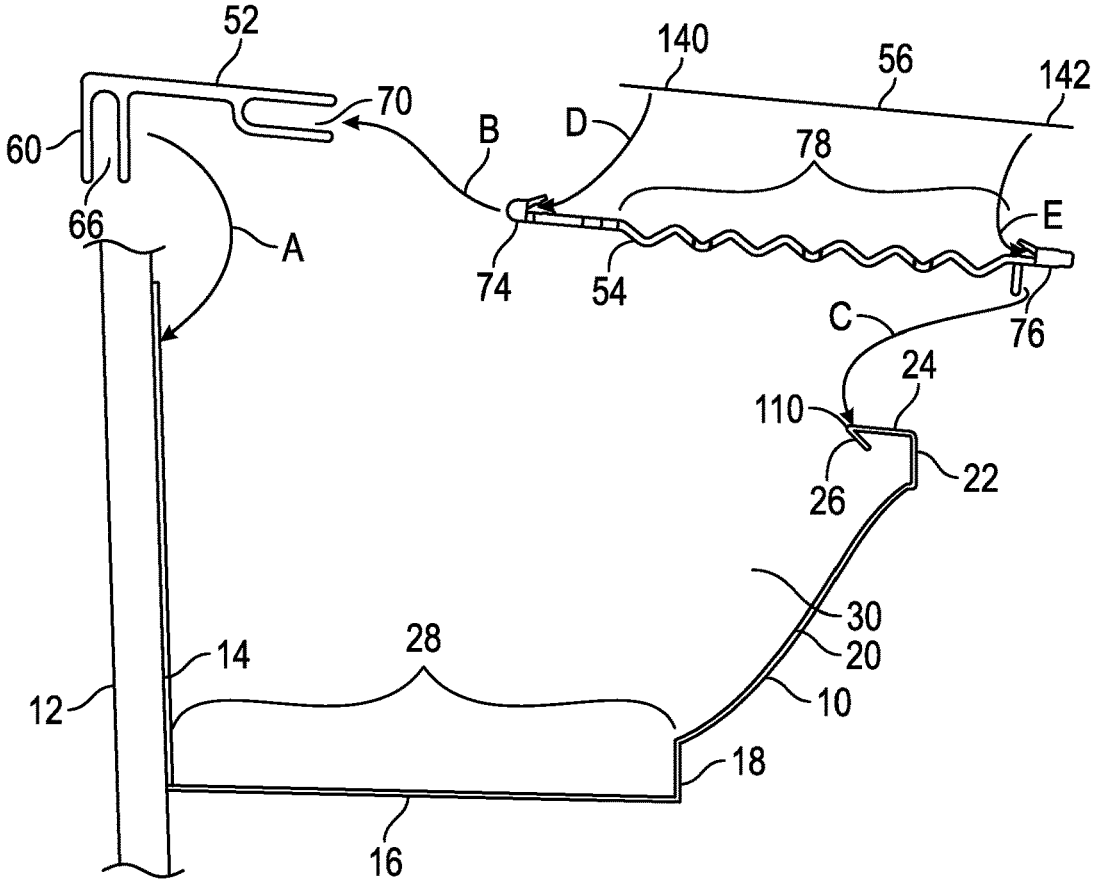
FIG. 2 is an exploded side elevational view of the gutter protection system of FIG. 1.

Referring now to FIGS. 1 and 2, a rain gutter is illustrated generally at 10. The rain gutter 10 is conventional in the art and will only be briefly described herein. The rain gutter 10 is attached to a portion of a structure 12, such as the non-limiting example of a facia board, and is configured to manage the flow of rainwater by collecting the rainwater and channeling that rainwater away from the structure 12.

Referring again to FIGS. 1 and 2, the rain gutter 10 includes a back wall 14, a bottom wall 16, a first front wall segment 18, a second front wall segment 20, a third front wall segment 22, an upper wall segment 24 and an inward wall segment 26.

Referring again to FIGS. 1 and 2, the back wall 14, bottom wall 16 and the first front wall segment 18 cooperate to form a first channel 28. The first channel 28 is configured to collect rainwater entering the rain gutter 10 and is further configured to direct the collected rainwater to downstream structures, such as the non-limiting examples of a gutter drop and a down spouts (not shown). While the embodiment shown in FIGS. 1 and 2 illustrates the first channel 28 as having a generally rectangular cross-sectional shape, in other embodiments, the first channel 28 can have any desired cross-sectional shape.

Referring again to FIGS. 1 and 2, the walls and wall segments 14, 16, 18, 20, 22, 24, 26 cooperate to form a second channel 30. The second channel 30 is configured to capture rainwater entering the rain gutter 10 and is further configured to direct the captured rainwater to the first channel 28. In the illustrated embodiment, the second channel 30 has a polygonal cross-sectional shape. However, in other embodiments, the second channel 30 can have any desired cross-sectional shape sufficient to capture rainwater entering the rain gutter 10 and direct the captured rainwater to the first channel 28.

Referring again to FIGS. 1 and 2, the rain gutter 10 is fitted with a novel gutter protection system 50 (hereafter "gutter system"). The novel gutter system 50 is configured to provide increased protection against debris from entering the rain gutter 10, improves the flow rate of rainwater through the gutter system 10, is structurally enhanced and is adjustable to accommodate a wide variety of gutter sizes and styles. The gutter system 50 includes a bracket 52, a base member 54 and a permeable member 56.

Figure 3:
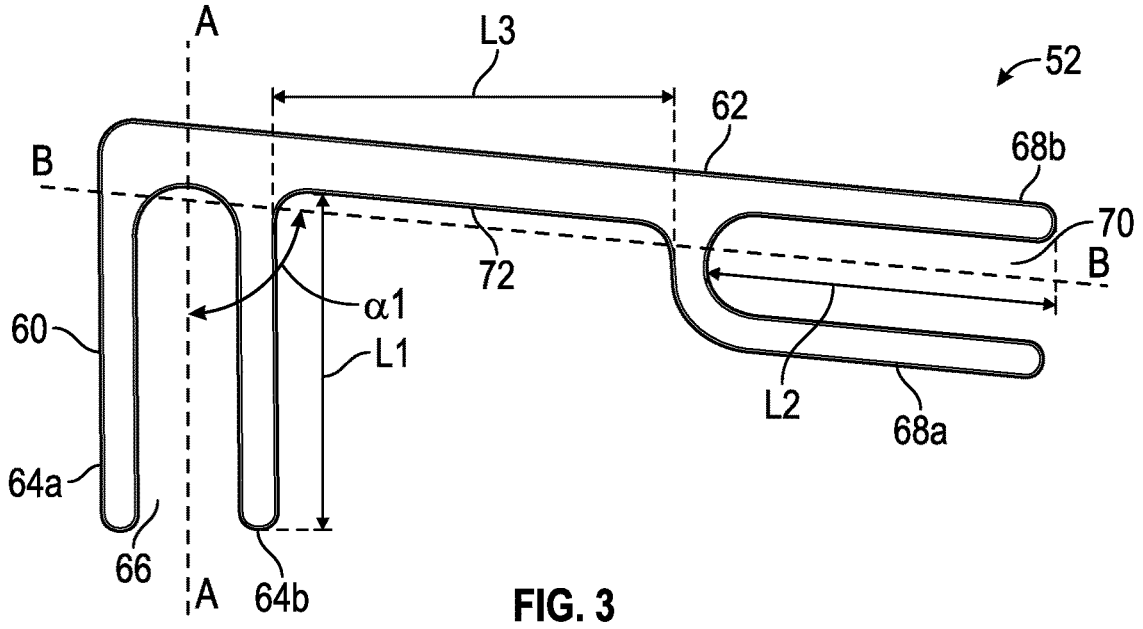
FIG. 3 is a side elevational view of a bracket of the gutter protection system of FIG. 1.

Referring now to FIGS. 1, 2 and 3, the bracket 52 includes a first arm 60 and a second arm 62. The first arm 60 includes spaced apart legs 64*a*, 64*b* configured to form a first channel 66 therebetween. The second arm 62 includes spaced apart legs 68*a*, 68*b* configured to form a second channel 70 therebetween. The first channel 66 has a length L1 and the second channel 70 has a length L2. The second arm 62 is spaced apart from the first arm 60 by an intermediate segment 72. The intermediate segment 72 has a length L3. In the illustrated embodiment, the lengths L1, L2 of the first and second channels 28, 30 are the same. However, in other embodiments, the lengths L1, L2 of the first and second channels 28, 30 can be different from each other.

Referring again to the embodiment shown in FIGS. 1, 2 and 3, each of the first and second channels 28, 30 of the bracket 52 have a substantially U-shaped cross-sectional presentation and are configured to accept portions of the base member 54 having a length in a range of from about 0.50 inches to about 1.25 inches. In alternate embodiments, each of the first and second channels 28, 30 of the bracket 52 can have other cross-sectional shapes and can accept portions of the base member 54 having lengths shorter than about 0.50 inches or longer than about 1.25 inches, sufficient to effectively couple the bracket 52 to the base member 54.

Referring now to FIG. 3, the first arm 60 has a longitudinal axis A-A and the second arm 62 has a longitudinal axis B-B. The longitudinal axis A-A and the longitudinal axis B-B form an angle $\alpha 1$ therebetween. In the illustrated embodiment, the angle $\alpha 1$ is less than 90 degrees. In a particular non-limiting example, the angle $\alpha 1$ is about 84 degrees. Without being bound to any particular theory, it is believed the flowrate of watershed over the gutter system 50 is enhanced where the longitudinal axis A-A is oriented around 84 degrees from the and the longitudinal axis B-B.

Referring again to FIGS. 1 and 2, in an installed arrangement, the first arm 60 of the bracket 52 is coupled to an interior surface of the back wall 14 of the rain gutter 10, as schematically depicted by direction arrow A. In certain instances, the first arm 60 of the bracket 52 is coupled to the back wall 14 through use of a fastener (not shown). In other embodiments, other structures can be used to couple the bracket 52 to the back wall 14, including the non-limiting example of an adhesive.

Referring again to FIGS. 1 and 2, in an installed arrangement, the intermediate segment 72 is configured to extend the second channel 70 a suitable distance from the back wall 14 of the rain gutter 10 so as to allow the second channel 70 to receive a portion of the base member 54. In alternate embodiments, where the distance from the back wall 14 of the rain gutter 10 to the third front wall segment 22 is shorter, advantageously the bracket 52 can be flipped in a manner such that the second arm 62 is attached to the back wall 14 of the rain gutter 10 and the first channel 28 extends to receive a portion of the base member 54. Insertion of a portion of the base member 54 into either of the first or second channels 28, 30 effectively couples the base member 54 to the bracket 52. It should be appreciated that one skilled in the art may select any dimension or range for the lengths of the arms 60, 62 and/or depths of the channels 66, 70 to permit the gutter system 50 to accommodate differently sized rain gutters 10, within the scope of the present disclosure.

Referring now to FIGS. 4-8, the base member 54 and/or portions of the base member 54 are illustrated. The base member 54 is configured for several functions. First, the base member 54 is configured to span the distance between the first or second channel 66, 70 of the bracket 52 to the upper wall segment 24 of the rain gutter 10 in a manner such as to secure the base member 54 in this arrangement. Second, the base member 54 is configured to structurally support and secure the permeable member 56. Finally, the base member 54 is configured to facilitate the flow of water through the gutter system 50 and into the rain gutter 10. The base member 54 includes a first end 74, an opposing second end 76, an intermediate section 78 extending therebetween, a top surface 80 and a bottom surface 82.

In the embodiment, shown in FIGS. 4-8, the base member 54 is formed as a unitary, one-piece structure and is formed from a metallic material or a metallic composite material, such as the non-limiting example of aluminum and/or an aluminum alloy. In alternate embodiments, the base member 54 can be formed from separate, discrete elements that are assembled together and can be formed from other suitable materials, including the non-limiting examples of polymeric-based materials, reinforced fiberglass-based materials and the like.

Figure 4:
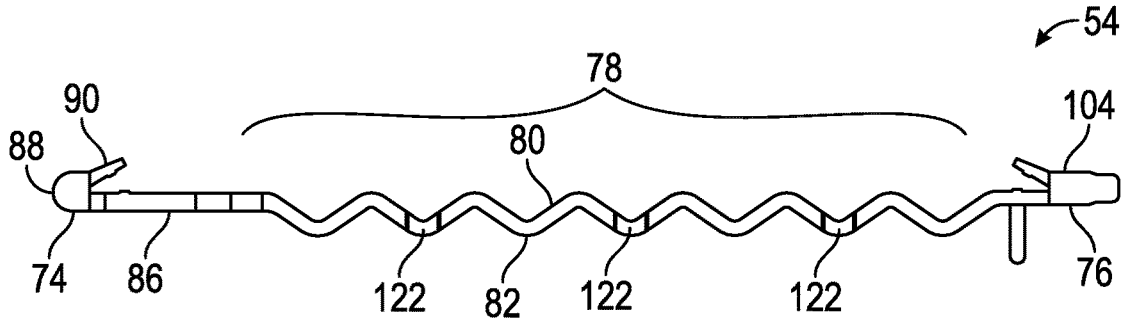
FIG. 4 is a side elevational view of a base member of the gutter protection system of FIG. 1.
Figure 5:
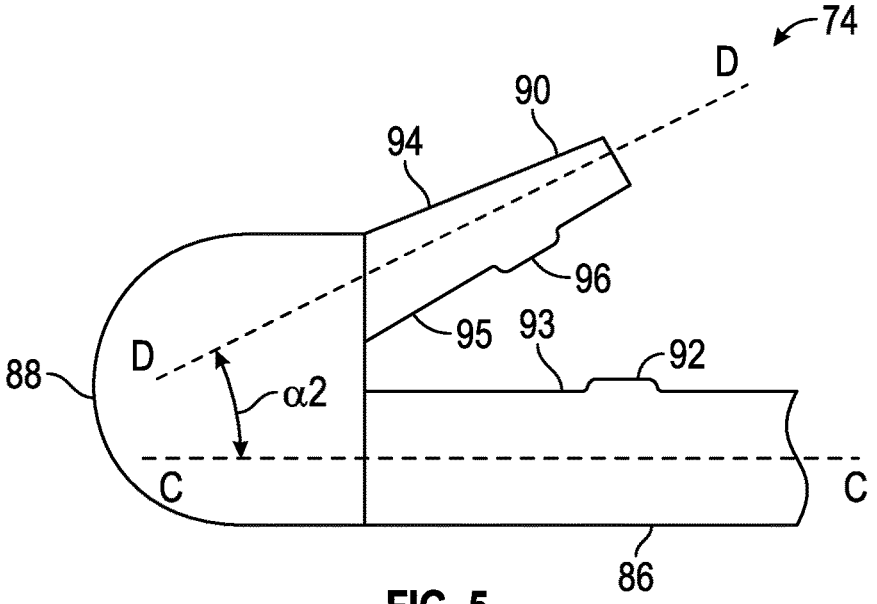
FIG. 5 is a side elevational view of a first end of the base member of FIG. 4.

Referring now to FIGS. 1, 4 and 5, the first end 74 of the base member 54 is illustrated. The first end 74 is configured for insertion into the first or second channel 66, 70 of the bracket 52, as schematically depicted by direction arrow B (FIG. 2), thereby securing the first end 74 of the base member 54 to either of the first arm 60 or the second arm 62 of the bracket 52. Referring now to FIG. 5, the first end 74 includes an extension segment 86, an end cap 88 and a coupling feature 90.

Referring again to FIGS. 1, 4 and 5, the extension segment 86 extends from the intermediate section 78 to the end cap 88. In an installed orientation, the extension segment 86 is configured to position the end cap 88 and the coupling feature 90 a distance within the first or second channel 66, 70 sufficient to secure the first end 74 of the base member 54 to either of the first arm 60 or the second arm 62 of the bracket 52.

Referring now to FIG. 5, the extension segment 86 includes a first tooth 92 and a longitudinal axis C-C. The first tooth 92 extends from a first surface 93. The first tooth 92 and the longitudinal axis C-C will be discussed in more detail below.

Referring now to FIGS. 1, 4 and 5, the end cap 88 is connected to the extension segment 86. The end cap 88 is configured to ease entry of the first end 74 into the first or second channel 66, 70. In the illustrated embodiment, the end cap 88 has a semi-circular cross-sectional shape configured to facilitate a slidable entry of the end cap 88 into the first or second channel 66, 70 of the bracket 52. In other embodiments, the end cap 88 can have other cross-sectional shapes sufficient to facilitate a slidable entry of the end cap 88 into the first or second channel 66, 70 of the bracket 52.

Referring again to FIGS. 1, 4 and 5, the coupling feature 90 extends from the end cap 88 and includes a coupling arm 94 having a first surface 95, a second tooth 96 and a longitudinal axis C-C. The first surface 95 of the coupling arm 94 faces the first surface 93 of the extension segment 86. As will be discussed in more detail below, the coupling arm 94 is flexible in a direction toward the extension segment 86.

The longitudinal axis C-C of the extension segment 86 and the longitudinal axis D-D form an angle $\alpha 2$ therebetween. The angle $\alpha 2$ is configured to receive an edge portion of the permeable member 56. In the illustrated embodiment, the angle $\alpha 2$ is in a range of from about 20 degrees to about 40 degrees. In a particular non-limiting example, the angle $\alpha 2$ is about 30 degrees.

Referring now to FIGS. 1, 4 and 5, in an installed arrangement with the first end 74 of the base member 54 positioned within either of the first or second channels 66, 70, the coupling arm 94 is flexed in a direction toward the extension segment 86. Flexing of the coupling arm 94 in this manner facilitates crimping by the first tooth 92 and the second tooth 96 against a portion of the permeable member 56, thereby securing the permeable member 56 in place against the base member 54. In the illustrated embodiment, the first tooth 92 and the second tooth 96 are disposed slightly offset from each other and act complementary to each other which enhances the securement of the permeable member 56 to the base member 54 as the crimping feature is engaged. Advantageously, the crimping feature provided by the first tooth 92 and the second tooth 96 militates against the need for adhering and/or caulking the permeable member 56 in a fixed position relative to the base member 54 and/or the rain gutter 10. As is known in the art and undesirably, adhesives and/or caulk deteriorate and produce a significant debris trap which may accumulate over time and inhibit the flow of water from passing through the gutter protection system 50. Accordingly, the crimping feature provided by the first tooth 92 and the second tooth 96 militates against debris from collecting along the first and second ends 74, 76 of the base member 54. It should be appreciated that in other embodiments, other suitable methods of coupling the permeable member 56 to the first end 74 of the base member 56 can be used.

Figure 6:
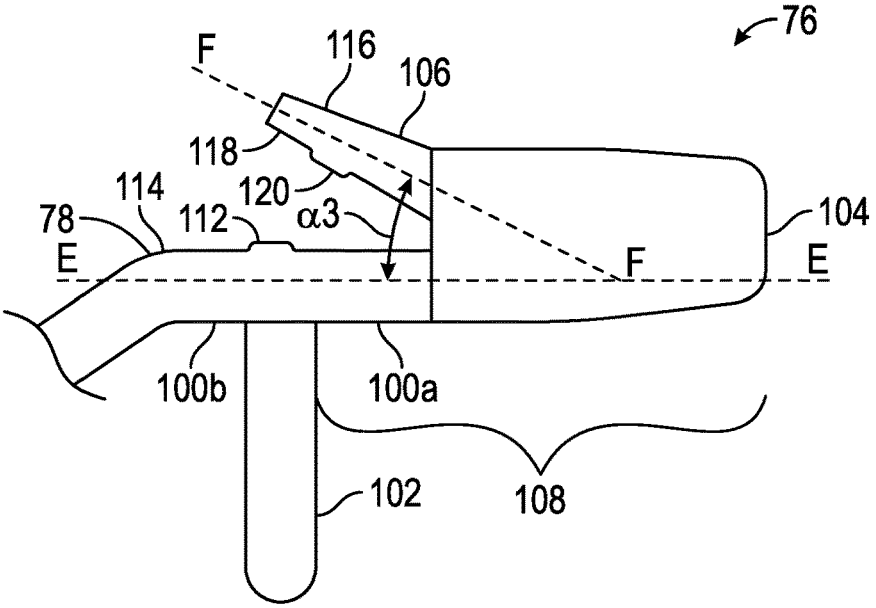
FIG. 6 is a side elevational view of a second end of the base member of FIG. 4.
Figure 7:
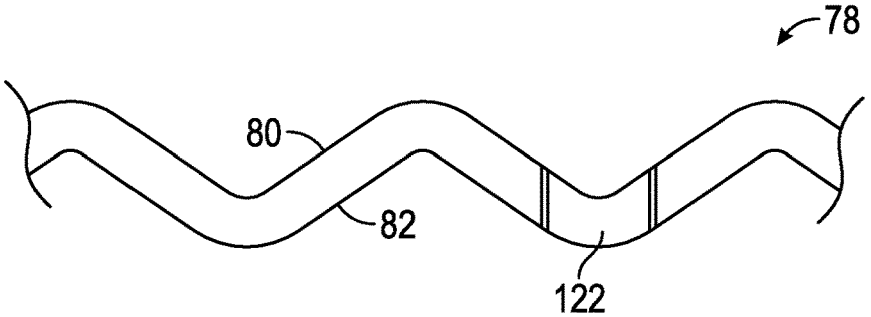
FIG. 7 is a side elevational view of a portion of the base member of FIG. 4.

Referring now to FIGS. 1, 4 and 6, the second end 76 of the base member 54 is illustrated. The second end 76 is configured for connection with the upper wall segment 24 and the inward wall segment 26 of the rain gutter 10, as schematically depicted by direction arrow C (FIG. 2), thereby securing the second end 76 of the base member 54 to rain gutter 10. Referring now to FIG. 6, the second end 76 includes a first extension segment 100*a*, a second extension segment 100*b*, a tab 102, an end cap 104 and a coupling feature 106.

Referring again to FIGS. 1, 4 and 6, the first extension segment 100*a* extends from the end cap 104 to the tab 102 and the second extension segment 100*b* extends from the tab 102 to the intermediate segment 78. The first extension segment 100*a* cooperates with a portion of the end cap 104 to form a substantially flat seat 108, configured to receive the upper wall segment 24 as the base member 54 is installed into the rain gutter 10.

Referring now to FIGS. 1, 2 and 6, the tab 102 extends in a downward direction from the first and second extension segments 100*a*, 100*b*. In and installed orientation, the tab 102 is configured to frictionally engage an intersection 110 formed by the upper wall segment 24 and the inward wall segment 26. Advantageously, the tab 102 securely couples the base member 54 to the rain gutter 10. In the illustrated embodiment, the tab 102 has a rectangular cross-sectional shape. In alternate embodiments, the tab 102 can have other suitable cross-sectional shapes sufficient to frictionally engage the intersection 110 formed by the upper wall segment 24 and the inward wall segment 26 and securely couple the base member 54 to the rain gutter 10.

Referring now to FIG. 6, the first and second extension segments 100*a*, 110*b* includes a third tooth 112 and a longitudinal axis E-E. The third tooth 102 extends from a first surface 114. The third tooth 112 and the longitudinal axis E-E will be discussed in more detail below.

Referring now to FIGS. 1, 4 and 6, the end cap 104 is connected to the first extension segment 100*a*. The end cap 104 is configured to ease the frictional engagement of the tab 102 with the intersection 110 formed by the upper wall segment 24 and the inward wall segment 26. In the illustrated embodiment, the end cap 104 has a semi-circular cross-sectional shape configured to facilitate urging by an installer of the second end 76 into an installed position. In other embodiments, the end cap 104 can have other cross-sectional shapes sufficient to facilitate the frictional engagement of the tab 102 with the intersection 110 formed by the upper wall segment 24 and the inward wall segment 26.

Referring again to FIGS. 1, 4 and 6, the coupling feature 106 extends from the end cap 104 and includes a coupling arm 116 having a first surface 118, a fourth tooth 120 and a longitudinal axis F-F. The first surface 118 of the coupling arm 116 faces the first surface 114 of the first and second extension segments 110*a*, 110*b*. As will be discussed in more detail below, the coupling arm 116 is flexible in a direction toward the first and second extension segments 110*a*, 110*b*.

The longitudinal axis E-E of the first and second extension segments 110*a*, 110*b* and the longitudinal axis F-F form an angle $\alpha 3$ therebetween. The angle $\alpha 3$ is configured to be small enough that an edge portion of the permeable member 56 inserted into the angle $\alpha 3$ engages both the third tooth 112 and the fourth tooth 120. In the illustrated embodiment, the angle $\alpha 3$ is in a range of from about 20 degrees to about 40 degrees. In a particular non-limiting example, the angle $\alpha 3$ is about 30 degrees.

Referring now to FIGS. 1, 4 and 6, in an installed arrangement with the second end 76 of the base member 54 seated against the upper wall segment 24 and the inward wall segment 26, the coupling arm 116 is flexed in a direction toward the first and second extension segments 110*a*, 110*b*. Flexing of the coupling arm 116 in this manner facilitates crimping by the third tooth 112 and the fourth tooth 120 against a portion of the permeable member 56, thereby securing the permeable member 56 in place against the second end 76 of the base member 54. In the illustrated embodiment, the third tooth 112 and the fourth tooth 120 are disposed slightly offset from each other and act complementary to each other which enhances the securement of the permeable member 56 to the second end 76 of the base member 54 as the crimping feature is engaged. Advantageously, the crimping feature provided by the third tooth 112 and the fourth tooth 120 militates against the need for adhering and/or caulking the permeable member 56 in a fixed position relative to the second end 76 of the base member 54 and/or the rain gutter 10. As is known in the art and undesirably, adhesives and/or caulk deteriorate and produce a significant debris trap which may accumulate over time and inhibit the flow of water from passing through the gutter protection system 50. Accordingly, the crimping feature provided by the third tooth 112 and the fourth tooth 120 militates against debris from collecting along the second end 76 of the base member 54. It should be appreciated that in other embodiments, other suitable methods of coupling the permeable member 56 to the second end 76 of the base member 56 can be used.

Referring now to FIGS. 1, 2, 4, 7 and 8, the intermediate section 78 is illustrated. The intermediate section 78 includes an upper surface 121*a*, an opposing lower surface 121*b*, a plurality of apertures 122 and a plurality of alternating raised 123*a* and lowered portions 123*b*. Each of the apertures 122 is positioned in the lowered portions to facilitate the flow of water through the gutter system 50 and into the rain gutter 10 and extend from the upper surface 121*a* to the opposing lower surface 121*b*. Each of the apertures 122 is configured to maximize water flow through the base member 54 while also enhancing structural integrity of the base member 54. In the illustrated embodiment, the apertures 122 are arranged in offsetting rows and have the form of slots, more specifically slots having a dog bone shape. The term offsetting rows, as used herein, is defined to mean the apertures in a first row are not aligned with the apertures in an adjacent row. Without being held to the theory, it is believed the dog bone shape of the apertures 122 enables the gutter system 50 to withstand the weight of snow or other environmental hazards while also maximizing the flowrate of watershed therethrough. It is also believed the dog-bone shape of the apertures 122 enhances the effectiveness of militating against debris from entering the rain gutter 10. However, in other embodiments, the apertures 122 can have other suitable shapes and can be arranged in other patterns, sufficient for the functions described herein.

Figure 8:
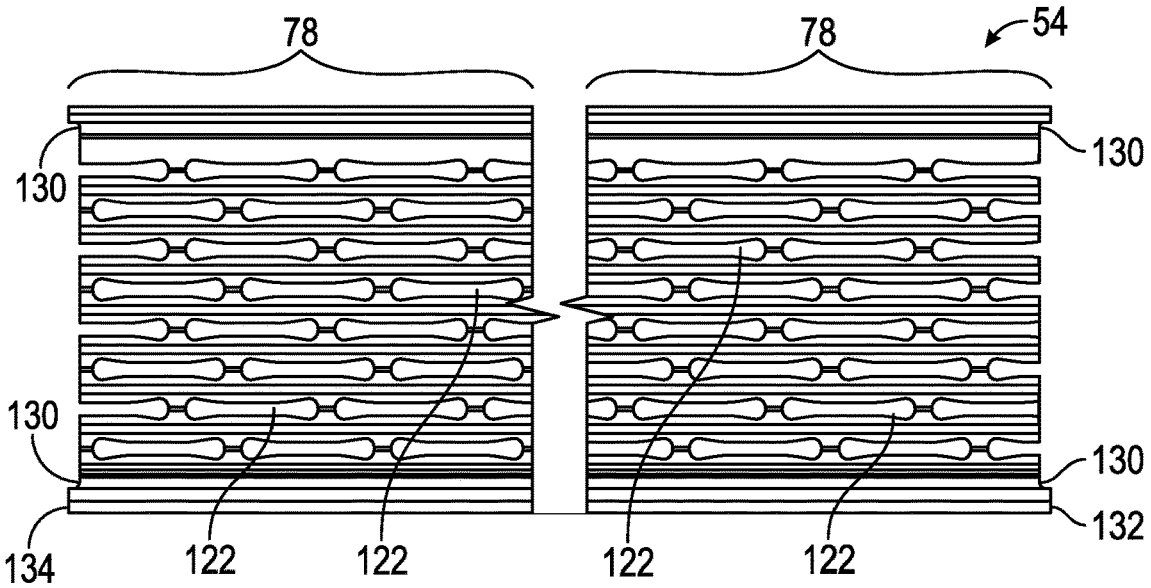
FIG. 8 is a plan view of the base member of FIG. 4.

Referring now to the embodiment illustrated in FIG. 8, the plurality of apertures 122 cover a majority of the surface area of the base member 54. As a non-limiting example, as shown in FIG. 8, approximately 66% or more of the surface area is defined by the plurality of apertures 122. Advantageously and without being held to the theory, where the surface area defined by the plurality of apertures 122 of the base member 54 covers more than 50% of the surface area of the base member 54, the capacity of water flowing through the base member 54 is enhanced.

Referring again to FIG. 8, the base member 54 includes notches 130, a first terminal end 132, and a second terminal end 134. The notches 130 are disposed near either or both of the first and second terminal ends 132, 134 or the second terminal end 148 of the base member 54. The notches 130 are configured to form openings or areas for portions of the permeable member 56 to be folded over either or both of the first terminal end 132 or the second terminal end 134. In other words, the notches 130 are configured to permit the permeable member 56 to be disposed within a recess formed by the notches 130 and folded over either or both of the first terminal end 132 or the second terminal end 134 of the base member 54, thereby forming a substantially flush surface along either or both of the first terminal end 132 or the second terminal end 134. In operation, it is contemplated a quantity of two (2) base members 54 may be disposed adjacent to each other in an end-to-end arrangement without a gap since the permeable member 56 is disposed within the recess. Advantageously, this seamless transition between adjacent base members 54 is configured to militate against debris collecting and/or falling within the rain gutter 10. A skilled artisan may select other suitable ways of creating a gapless transition between adjacent base members 54, within the scope of the present disclosure.

Referring now to FIGS. 1, 2 and 8, the permeable member 56 is illustrated. The permeable member 56 is configured for several functions. First, the permeable member 56 is configured to prevent debris from entering the rain gutter 10. Second, the permeable member 56 is configured to facilitate the flow of water through the gutter system 50 and into the rain gutter 10. Finally, the permeable member 56 is configured to resist deterioration due to environmental conditions. In the illustrated embodiment, the permeable member 56 is formed from a metallic material, such as the non-limiting example of a grade 316 stainless steel, and has a grid size of about 30 mesh. However, it is contemplated that the permeable member 56 can be formed from other suitable materials, such as the non-limiting example of reinforced polymetric materials and can have a grid size of more than or less than about 30 mesh, suitable to prevent debris from entering the rain gutter 10 and to resist deterioration due to environmental conditions.

Figure 9:
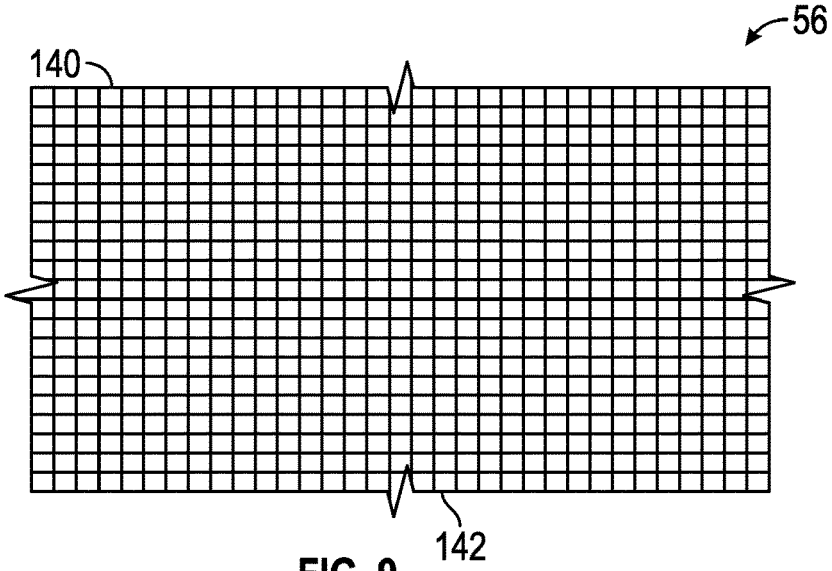
FIG. 9 is a plan view of a permeable member of the gutter protection system of FIG. 1.

Referring now to FIGS. 2, 8 and 9, the permeable member 56 has a first edge 140 and an opposing second edge 142. The first edge 140 is configured for insertion into the first end 74 of the base member 54 between the first tooth 92 and the second tooth 96 and further configured for crimping by the first tooth 92 and the second tooth 96, as shown schematically by direction arrow D. The second edge 142 is configured for insertion into the second end 76 of the base member 54 between the third tooth 112 and the fourth tooth 120 and further configured for crimping by the third tooth 112 and the fourth tooth 120, as shown schematically by direction arrow E. After the crimping actions of the teeth 92, 96, 112, 120, the permeable member 56 is seated against the upper surface 80 of the base member 54 and secured in place. While the permeable member 56 is described above a secured to the base member 54 by crimping actions of the teeth 92, 96, 112, 120, it is contemplated that in other embodiments, the permeable member 56 can be secured to the base member 54 with other structures, mechanisms and devices.

It should be appreciated that in certain instances, the permeable member 56 can be attached to the base member 54 during installation of the gutter system 50. In other instances, the permeable member 56 can be attached to the base member 54 prior to arrival of the gutter system 50 at an installation site. One non-limiting example of a pre-installation site attachment of the permeable member 56 to the base member 54 is at a factory setting.

The gutter system 50 provides many advantages over conventional gutter protection systems, however all advantages may not be available in all embodiments. First, the gutter system 50 is adjustable to rain gutters having a wide variety of sizes and styles. Second, the gutter system 50 provides greater protection for militating against debris from entering a rain gutter. Third, the gutter system 50 improves the water flow rate through the gutter system 50 and into the rain gutter. Finally, the gutter system 50 is configured to structurally enhance a rain gutter.

Figure 10:
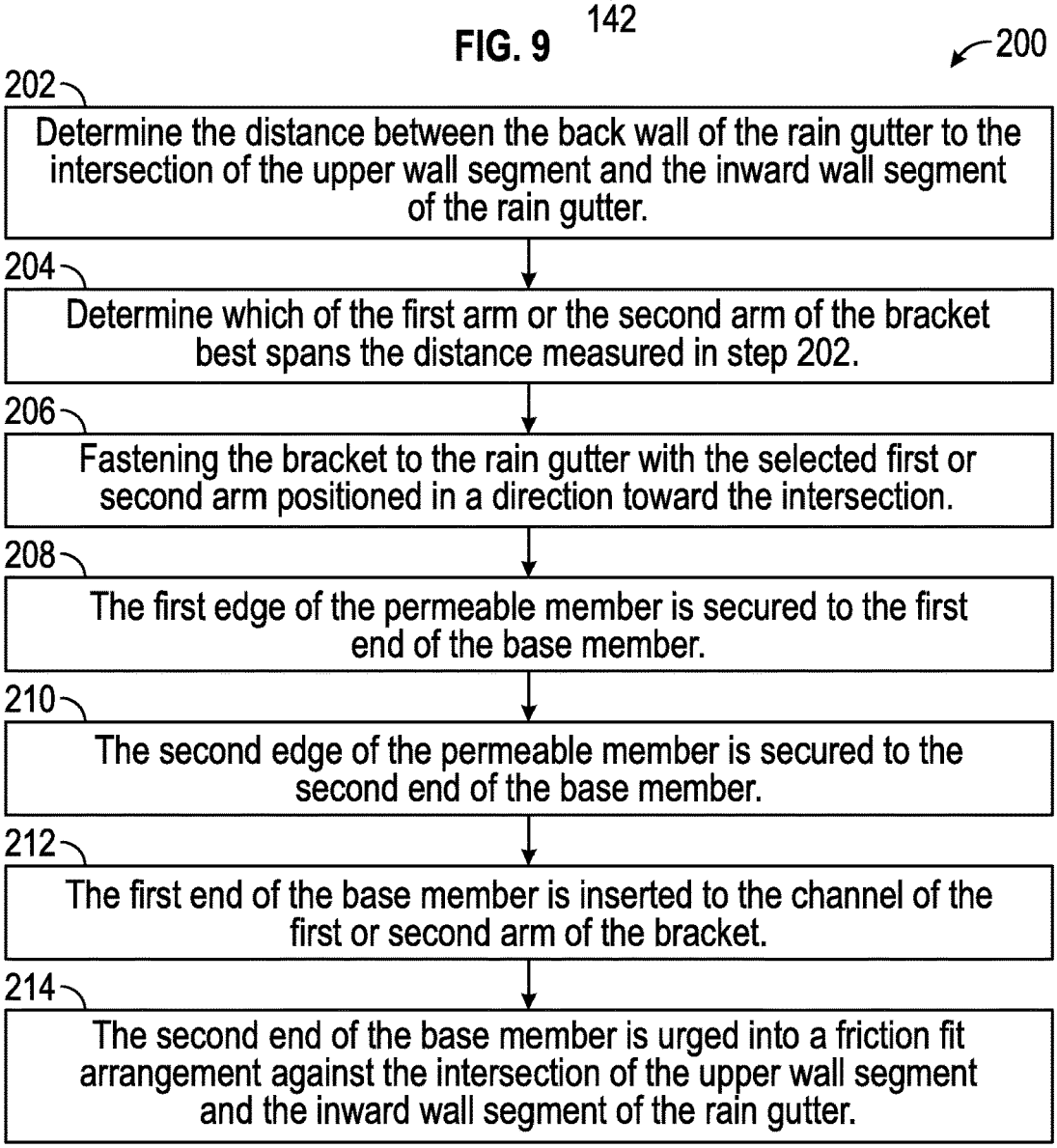
FIG. 10 is a flow chart illustrating a method of installing the gutter protection system of FIG. 1.

Referring now to FIGS. 1 and 10, a method of installing the gutter system 50 will now be described at 200. In an initial step 202, the distance between the back wall 14 of the rain gutter 10 to the intersection 110 of the upper wall segment 24 and the inward wall segment 26 of the rain gutter 10 is determined. In a next step 204, it is determined which of the first arm 60 or the second arm 62 of the bracket best spans the distance measured in step 202. In a next step 206, the bracket 52 is fastened to the rain gutter 10 with the selected first or second arm positioned in a direction toward the intersection 110. Next, in step 208, the first edge 140 of the permeable member 54 is secured to the first end 74 of the base member 54. Next, in step 210, the second edge 142 of the permeable member 54 is secured to the second end 76 of the base member 54. In next step 212, the first end 74 of the base member 54 is inserted to the channel 66 or 70 of the first or second arm 60, 62 of the bracket 52. In a final installation step 214, the second end 76 of the base member 54 is urged into a friction fit arrangement against the intersection 110 of the upper wall segment 24 and the inward wall segment 26 of the rain gutter 10.

Referring again to FIG. 2, it is contemplated that in certain embodiments the gutter system 50 can be provided in the form of a kit. The kit includes one or more brackets 52, one or more base members 54 and one or more permeable members 56.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A gutter protection system configured for engagement with a rain gutter, the gutter protection system comprising:

a bracket configured for attachment to a first portion of the rain gutter, the bracket having a first arm and a second arm, each of the first and second arms including substantially parallel and coextensive legs forming a channel between the legs of each of the first and second arms;

a base member having a first end configured for insertion into the channel formed by the first arm or the second arm of the bracket, the base member further having an opposing second end configured for engagement with a second portion of the rain gutter, the base member further including an intermediate section extending from the first end to the second end, the intermediate section including a plurality of apertures; and a permeable member seated against an upper surface of the base member and configured to facilitate the flow of water through the gutter protection system and into the rain gutter.

2. The gutter protection system of claim 1, wherein the first arm has a length that is longer than the second arm.

3. The gutter protection system of claim 1, wherein a longitudinal axis of the first arm forms an angle with a longitudinal axis of the second arm, and wherein the angle is about 84 degrees.

4. The gutter protection system of claim 1, wherein the first end of the base member includes an extension segment, an end cap and a coupling feature.

5. The gutter protection system of claim 4, wherein the first end of the base member includes a plurality of teeth configured to engage the permeable member in a manner such as to secure the permeable member to the first end of the base member.

6. The gutter protection system of claim 5, wherein the plurality of teeth are offset from each other.

7. The gutter protection system of claim 1, wherein the second end of the base member includes a plurality of teeth configured to engage the permeable member in a manner such as to secure the permeable member to the second end of the base member.

8. The gutter protection system of claim 7, wherein the plurality of teeth are offset from each other.

9. The gutter protection system of claim 1, wherein the second end includes a tab configured for engagement with the second portion of the rain gutter.

10. The gutter protection system of claim 1, wherein the intermediate section of the base member includes a plurality of alternating raised and lowered portions.

11. The gutter protection system of claim 10, wherein each of the plurality of apertures is positioned in a lowered portion.

12. The gutter protection system of claim 1, wherein each of the plurality of apertures has the shape of a dog bone.

13. The gutter protection system of claim 1, wherein the plurality of apertures cover over 60% of the surface area of the intermediate section.

14. A method of assembling a gutter protection system, the method comprising the steps of:

attaching one of a first arm and a second arm of a bracket to a first portion of a rain gutter, each of the first and second arms including substantially parallel spaced apart coextensive legs forming a channel between the legs of each of the first and second arms;

inserting a first end of a base member into the channel of the first arm or the second arm of the bracket, the base member further having an opposing second end configured for engagement with a second portion of the rain gutter, the base member further including an intermediate section extending from the first end to the second end, the intermediate section including a plurality of apertures; and seating a permeable member against an upper surface of the base member, the permeable member configured to facilitate the flow of water through the gutter protection system and into the rain gutter.

15. The method of claim 14, including the step of forming the first arm with a length that is longer than a length of the second arm.

16. The method of claim 14, including the step of forming the first end of the base member with an extension segment, an end cap and a coupling feature.

17. The method of claim 14, including the step of forming the first end of the base member with a plurality of teeth configured to engage the permeable member in a manner such as to secure the permeable member to the first end of the base member.

18. The method of claim 14, including the step of forming the second end of the base member with a plurality of teeth configured to engage the permeable member in a manner such as to secure the permeable member to the second end of the base member.

19. The method of claim 18, including the step of offsetting the plurality of teeth from each other.

20. A kit for a gutter protection system, the kit comprising:

a bracket configured for attachment to a first portion of the rain gutter, the bracket having a first arm and a second arm, each of the first and second arms including substantially parallel and coextensive legs forming a channel between the legs of each of the first and second arms;

a base member having a first end configured for insertion into the channel formed by the first arm or the second arm of the bracket, the base member further having an opposing second end configured for engagement with a second portion of the rain gutter, the base member further including an intermediate section extending from the first end to the second end, the intermediate section including a plurality of apertures; and a permeable member seated against an upper surface of the base member and configured to facilitate the flow of water through the gutter protection system and into the rain gutter.

* * * * *